US006665959B1

(12) United States Patent
Vindriis

(10) Patent No.: US 6,665,959 B1
(45) Date of Patent: Dec. 23, 2003

(54) INSOLE

(76) Inventor: Soren Vindriis, Tulipanparken 43, DK-8700 Horsens (DK)

( * ) Notice: Subject to any disclaimer, the term of this patent is extended or adjusted under 35 U.S.C. 154(b) by 74 days.

(21) Appl. No.: 10/048,314

(22) PCT Filed: Jul. 12, 2000

(86) PCT No.: PCT/DK00/00390

§ 371 (c)(1),
(2), (4) Date: Jan. 29, 2002

(87) PCT Pub. No.: WO01/08523

PCT Pub. Date: Feb. 8, 2001

(30) Foreign Application Priority Data

Jul. 30, 1999 (DK) ..... 1999 01075

(51) Int. Cl.[7] ..... A43B 13/38; A43B 23/00; A43B 13/20

(52) U.S. Cl. ..... 36/44; 36/3 B; 36/29; 36/30 R

(58) Field of Search ..... 36/43, 3 R, 3 B, 36/28, 29, 30 R, 35 R, 37, 44, 153

(56) References Cited

U.S. PATENT DOCUMENTS

| | | | | | |
|---|---|---|---|---|---|
| 4,005,532 | A | * | 2/1977 | Giese et al. | 36/44 |
| 4,017,931 | A | | 4/1977 | Golden | |
| 4,073,072 | A | * | 2/1978 | Gross et al. | 36/44 |
| 4,270,966 | A | * | 6/1981 | Kihara | 36/43 |
| 4,297,796 | A | * | 11/1981 | Stirtz et al. | 36/28 |
| RE32,698 | E | * | 6/1988 | Brown | 36/44 |
| 5,025,575 | A | | 6/1991 | Lakic | |
| 5,067,255 | A | | 11/1991 | Hutcheson | |
| 5,070,629 | A | * | 12/1991 | Graham et al. | 36/28 |
| 5,727,336 | A | * | 3/1998 | Ogden | 36/43 |
| 5,729,917 | A | * | 3/1998 | Slepian et al. | 36/28 |
| 5,852,886 | A | * | 12/1998 | Slepian et al. | 36/28 |
| 5,860,226 | A | * | 1/1999 | Graham et al. | 36/28 |
| 5,974,695 | A | * | 11/1999 | Slepian et al. | 36/28 |
| 6,158,149 | A | * | 12/2000 | Rudy | 36/29 |
| 6,457,263 | B1 | * | 10/2002 | Rudy | 36/29 |

FOREIGN PATENT DOCUMENTS

| | | |
|---|---|---|
| DE | 3032941 | 4/1982 |
| DE | 2 9603914 | 6/1996 |
| DK | 19 9801382 | 10/1998 |
| SE | 443908 | 3/1986 |
| WO | WO 974071 | 11/1997 |
| WO | WO 0024283 | 5/2000 |

* cited by examiner

*Primary Examiner*—Anthony D. Stashick
(74) *Attorney, Agent, or Firm*—Ladas & Parry

(57) ABSTRACT

The invention concerns an insole for footwear. The insole comprises a liquid-filled sole with a top sheet and a back sheet between which is formed at least one chamber with liquid. On top of the liquid-filled sole there is provided a net. The net creates a spacing between the top sheet and the foot, and the net is capable of containing air absorbing moisture from foot perspiration. By using a net on top of a liquid-filled sole it is achieved that the foot perspiration formed because of frictional heat and muscle contractions when using liquid-filled soles is more easily contained in the net and more easily conducted around in the net along the plane of the net as a pumping effect of air in the net arises when the liquid-filled sole is imparted movement by the foot.

8 Claims, 6 Drawing Sheets

INSOLE

BACKGROUND OF THE INVENTION

The present invention relates to a liquid-filled insole for footwear.

The invention also concerns a method for making an insole for footwear, the sole at least comprising a support for the foot in the footwear, and which sole in addition comprises a net of threads disposed on top of the support, the net creating a distance between the support and the foot in the footwear, and where net is joined with the support along an outer edge of the net.

DE 296 03 914 describes an insole of this type. The insole comprises a support at the heel of the foot in the footwear. The support consists of an elastic material that may be compressed for relieving the heel. The support may be made of a foam synthetic or of cork. On top of the centre area of the support a net is disposed. The net consists of two layer of synthetic threads which are woven or knitted. The net is fastened to the support at the heel by welding. The net extends from the heel of the foot and forward right up to the toes of the foot in the footwear. From the heel and further under the metatarsus, under the ball of the foot and under the toes there is no support under the net. The net gives the possibility of air passing transversely of the net between the foot and the support of the insole and the inner sole in the footwear, respectively.

This sole implies the possibility of relieving the heel and of supplying air to the foot in the footwear. The insole has, however, some drawbacks. The net is fixed in relation to the support and in relation to the insole of the footwear. This means that air flow in the net depends on differences in moisture of the air contained in the net. This causes the air flow in the net to be very limited, implying that the parts of the foot developing the largest amount of moisture are only negligibly supplied new air. Furthermore, the net does not extend over all of the width of the sole at the heel and the metatarsus of the foot in the footwear. This implies that no exchange of air can take place laterally of the net. The comfort of the foot in the footwear is therefore very limited even though the foot rests on a net establishing a distance between the foot and the support and the inner sole of the footwear, respectively.

In U.S. Pat. No. 5,067,255, a liquid-filled insole is disclosed for cushioning and impact absorption. The insole may be covered by, for example, a fabric or leather.

Liquid-filled soles are intended to reduce and to vary the load on the foot when walking and standing. Especially by standing work, the increased movement of the foot caused by liquid-filled soles gives rise to increased excretion of foot perspiration. This causes more people to refrain from using liquid-filled soles in spite of the ergonomic advantages by using the soles.

It is the purpose of the present invention to provide a liquid-filled sole where the inconvenience by using liquid-filled soles is greatly reduced.

This purpose is achieved with an insole which is peculiar in that the support is a liquid-filled sole with a top sheet and a back sheet between which is formed a chamber containing liquid, that the outer edge of the net is joined with the top sheet and the back sheet, and that the net at least extends from an area at the heel of the foot to an area at the ball of the foot in the foot wear and at least extends over the whole width of the sole.

The method according to the invention is peculiar in that a top sheet and a back sheet are welded together at the outer edges in that a chamber containing liquid is established between the two sheets, and that the net in a subsequent step is welded together at the edge area in a position superposing the top sheet.

By providing a net on the liquid-filled sole, the increased foot perspiration arising from the use of liquid-filled sole may more easily be conducted away from the underside of the foot.

By laying the net upon a sole containing liquid between a top sheet and a back sheet, the possibility of moving the net relative to the movements of the foot is established This implies that as soon as the foot is moved, the net will also be moved, and this creates an air flow, not only transversely of the net, but also longitudinally of the net. This means that air with high humidity contained in the net, e.g. typically under the heel or under the ball of the foot, will be passed to other parts of the net, e.g. under the metatarsus or under the toes where the air humidity is not so high. This causes the air humidity to be lesser locally as the moisture is distributed over all of the longitudinal and preferably also trasversal extension of the net.

Due to the fact that net provided on liquid soles improves the ability of the net to create ventilation between the foot ent the underlying sole, the net improves the function of the liquid filled sole.

By making the insole in two steps as defined by the method according to the invention, it is possible to achieve a plane net upper side simultaneously with increasing the height in the chamber. Hereby the relief and the liquid support of the foot will be considerably increased.

Preferably, the net will extend over all the transverse extension of the sole. Hereby the outermost part of the net along the edge area will be situated outside the limits of the foot. The part of the net located outside the foot thus has a free upper side enabling discharge of air with great humidity from the interspace under the foot simultaneously with fresh air with low humidity from other parts of the footwear may be conducted into the interspaces in the net under the foot. The free edge area is thus advantageous in enabling an increased ventilation and air flow in the net of the sole.

In a preferred embodiment, the insole is peculiar in that the net comprises a coarse net and a fine net, that the coarse net consists of threads with a given greater thickness T, that the fine net consists of threads with a given lesser thickness t less than the thickness T, and that the coarse net is disposed between the top sheet and the fine net, and that the fine net is disposed on top of the coarse net.

Depending on the weaving, a coarsely woven net with thick threads is capable of containing more air and thereby more humid air than a fine net. However, the coarsely woven net also has a more rough surface. This may give rise to greater discomfort for the foot in the footwear, and may also imply more wear on stockings or socks on the foot. A finely woven net cannot contain so much air but in the opposite is more comfortable to tread on, and the risk of socks being broken is less. By laying a coarsely woven net lowermost adjacent to the top sheet and a more finely woven net facing the foot on top of the coarse net, the advantages of the coarse net will be combined with the advantages of the finer net without reducing the possibility of air to be conducted longitudinally of the sole.

In a further preferred embodiment, the insole is peculiar in that a moisture absorbing fabric coating is provided between the top sheet and the net.

By providing the top sheet with a moisture absorbing fabric coating, the airborne moisture arising in the net from the foot in the footwear will be absorbed by the fabric coating. This means that the moisture is conducted away from the foot, down through the net where the moisture is distributed longitudinally of the net each time the foot is moved, and further down to the fabric coating on the top sheet. The moisture will thus always be conducted away from the foot. When the net, when provided on a liquid sole, is capable of distributing the humid air over all of the longitudinal extension of the net, then the fabric coating will also absorb the moisture over all of the length of the fabric coating, said length at least being the same as for the net.

DESCRIPTION OF THE DRAWING

The invention will then be described in more detail with reference to the accompanying drawing, where.

DETAILED DESCRIPTION OF THE INVENTION

Figure 1:
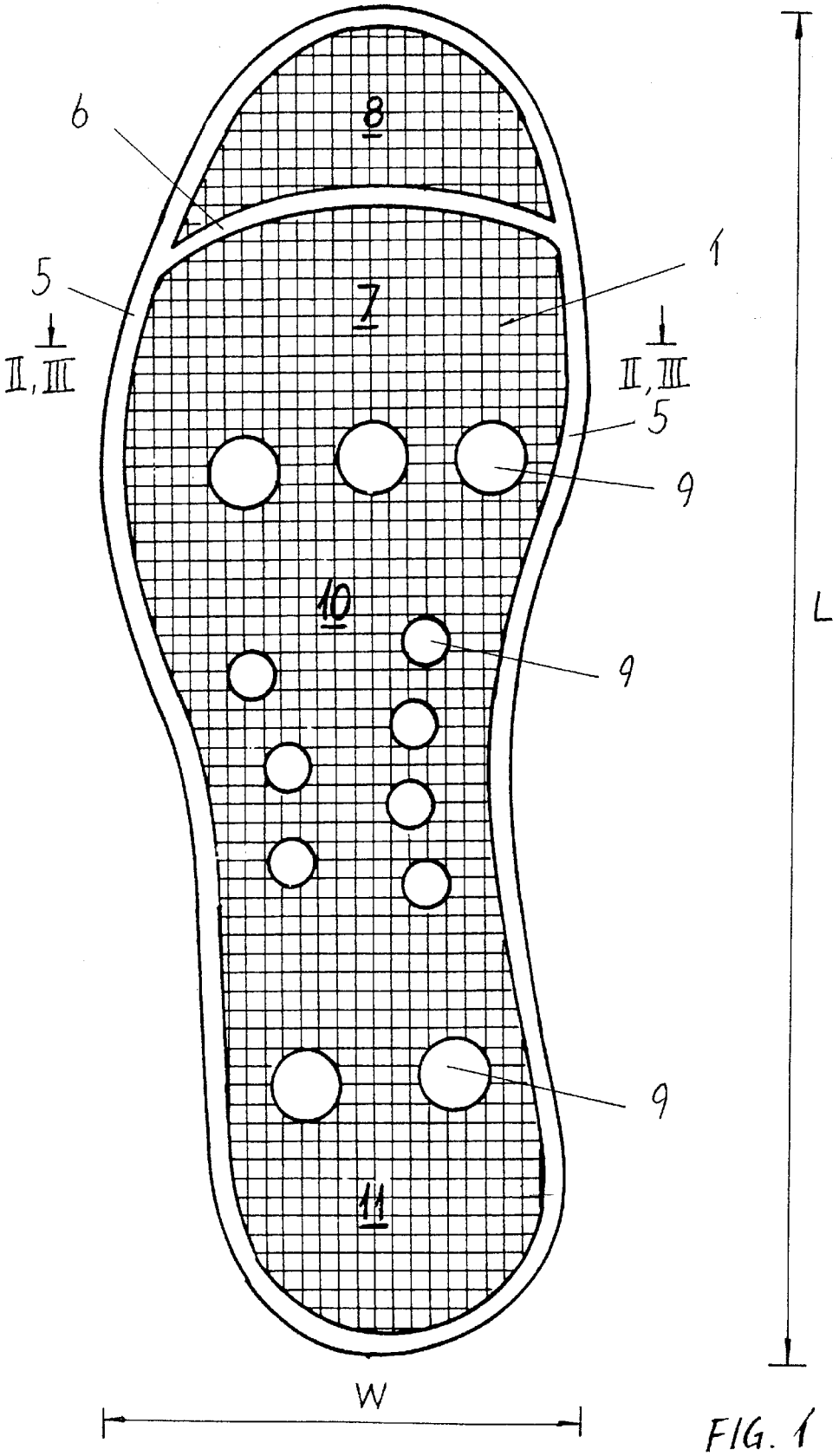
FIG. 1 is a view from above of an insole according to the invention.
Figure 2:
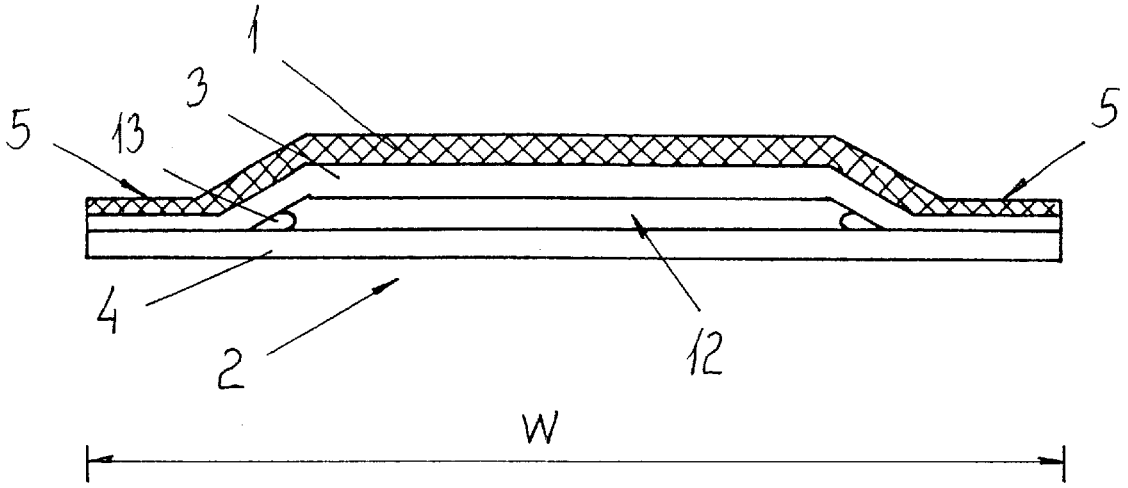
FIG. 2 is a transverse sectional view of a first embodiment of the sole.

FIG. 1 shows a net 1 provided on a liquid-filled sole 2 (see FIG. 2). The liquid-filled sole is situated under the net. The liquid-filled sole 2 comprises at least a top sheet 3 and a back sheet 4 (see FIG. 2), preferably of plastic, which are joined along outer edges 5 of the sole, along a line 6 transverse to the sole between an area 7, where the ball of the foot rests, and an area 8, where the toes rest, as well as at points 9 in an area 10 between an area 11 for the heel of the foot and the area 7 of the ball of the foot. The joint at the points 9 form flow barriers for the liquid in the liquid-filled sole 2 so that the flow of the liquid between a rear part and a front part of the sole occurs with a certain sluggishness. Joining of the top sheet and the back preferably takes place by high frequency welding.

In the shown embodiment, the net 1 disposed on top of the top sheet extend over the whole length L of the sole and over the whole width W of the sole. In alternative embodiments, the net may only extend a part of the length of the sole, e.g. from the area 10 at the heel to the area 7 for the ball of the foot to the line 6 formed between the area 7 for the ball of the foot and the area 8 for the toes.

Figure 3:
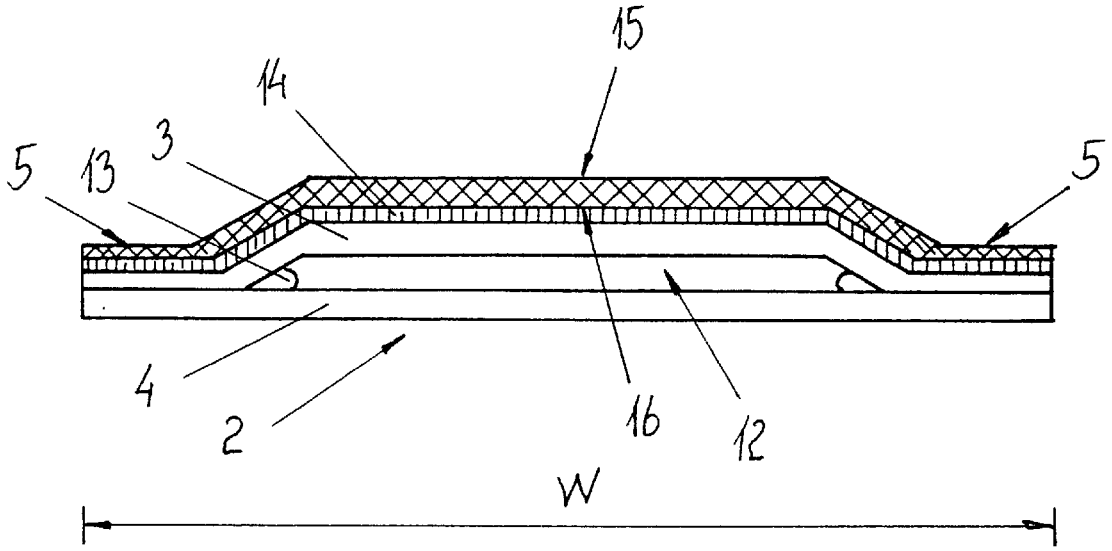
FIG. 3 is a transverse sectional view of a second embodiment of the sole.

FIGS. 2 and 3 show schematically a first embodiment of a sole according to the invention and a second embodiment of a sole according to the invention, respectively. FIG. 2 shows a liquid-filled sole 2 comprising a top sheet 3 and a back sheet 4. Between the sheets 3,4 is formed a chamber 12 filled with liquid. The top sheet 3 and the back sheet 4 are joined along the edges 5 of the sheets. A bead 13 extends into the chamber 12 and stems from welding together of the edges 5 of the sheets 3,4, where some of the sheet material from the edge of the sheets has flowed inward toward the chamber.

The net 1 is placed on the top sheet 3. The net 1 extends over the whole width W of the sole. The net 1 is joined along an edge of the net with the top sheet, at least. The net is also joined, preferably by welding, with the top sheet. The net is flexible upward and downward to a degree at least corresponding to the occurring compression of the chamber so that the net may follow the movements of the sole. The net can be made of different synthetic as well as natural materials like plastic and cotton, but are preferably made of plastic. Several plastic materials are suitable for making the net, for example PVdC, PU, EVA and PVC provide the possibility of welding the net to the top sheet by means of high frequency welding.

FIG. 3 shows a second embodiment where between the top sheet 3 and the net 1 is provided a moisture absorbing fabric coating 14. The fabric coating 14 is capable of absorbing moisture and is e.g. made of cotton. The fabric coating 14 is welded together with the net 1 along the edges of the net and the top sheet 3, respectively. The moisture from foot perspiration conducted down through the net 1 from the upper side of the net 1 where the foot rests (see FIG. 4), is then absorbed by the fabric coating 14. Thereby the moisture in the air is considerably reduced between an upper side 15 of the net and an underside 16 of the net. This embodiment is specially suitable for users with large excretion of foot perspiration.

Figure 4:
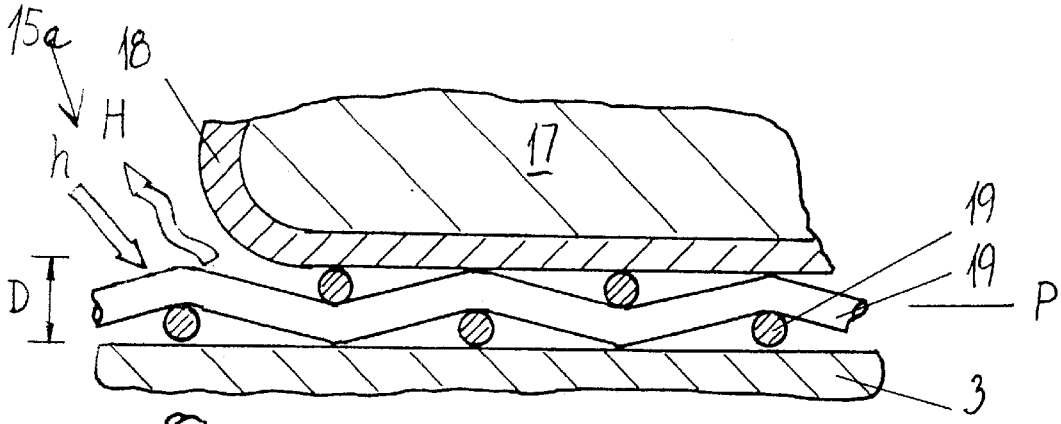
FIG. 4 is an enlarged sectional view of a part of the first embodiment of the sole when in use.

FIG. 4 shows a net 1 upon which a foot 17 with a sock 18 or stocking rests. The net 1 is situated between the top sheet 3 and the foot 17 and creates a distance D between the top sheet 3 and the foot 17. The net 1 is made of threads 19 which in the shown embodiment are woven. The threads 19 may also be knitted or may be non-woven, The have a diameter c. In meshes 20 (see FIG. 5) between the threads 19 in the net 1 there is air, and moisture from foot perspiration from the foot sole may be diffused down in the air between the meshes 20 between the threads 19. The meshes have width and length E, respectively. The distance D between the top sheet 3 and the foot 17 is typically between 0.3 and 5.0 mm. The distance D and the size E of the meshes depend on the diameter c of the threads 19 and on how the threads 129 are woven, knitted or interconnected in another way.

The net preferably extends over all the transverse dimension of the sole. This means that the outermost part of the net is situated outside the limits of the foot. The part of the net situated outside the foot has a free upper side 15*a*. From the free upper side 15*a* there is possibility of air H from under the foot with large humidity may be conducted out of the net and possibility of fresh air h from other parts of the footwear with lower humidity than under the foot may be conducted into the net.

Figure 5:
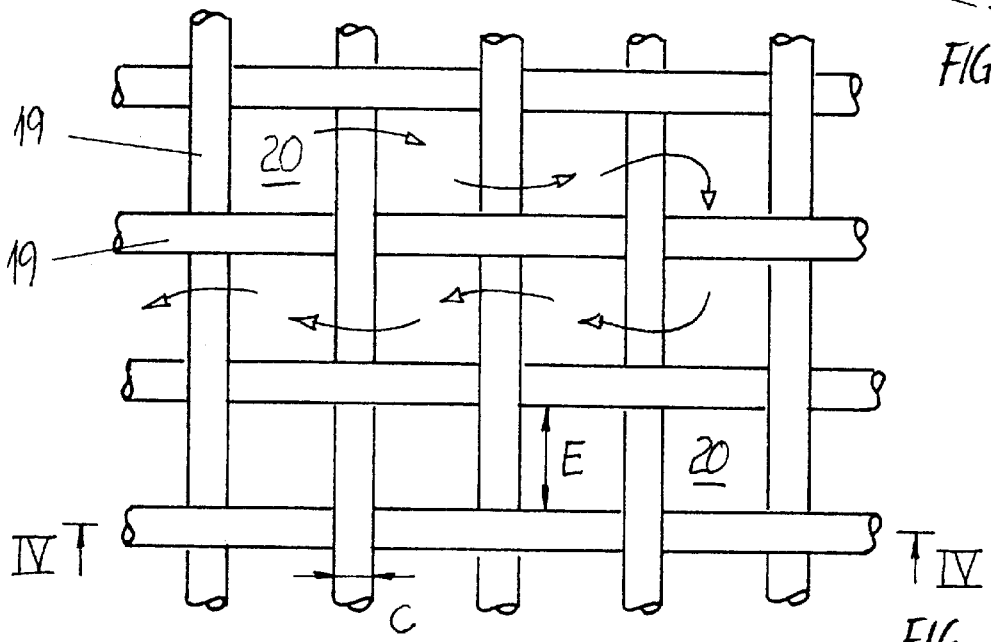
FIG. 5 is a view from above of a possible weaving of the threads in the net of the sole.

FIG. 5 shows how the air in the meshes 20 between the threads 19 is transported between the meshes 20 both longitudinally of the net and crosswise of the net along the plane P of the net (see FIG. 4). Transportation of air occurs when the liquid-filled sole is moved each time the person stands or walks. The liquid in the sole is conducted between the different areas of the sole under the heel, the metatarsus and the ball of the foot (see FIG. 1), respectively. Movement of the liquid-filled sole imparts a kind of pumping movement to the air in the net so that the air is transported around in the net along the plane of the net.

Figure 6:
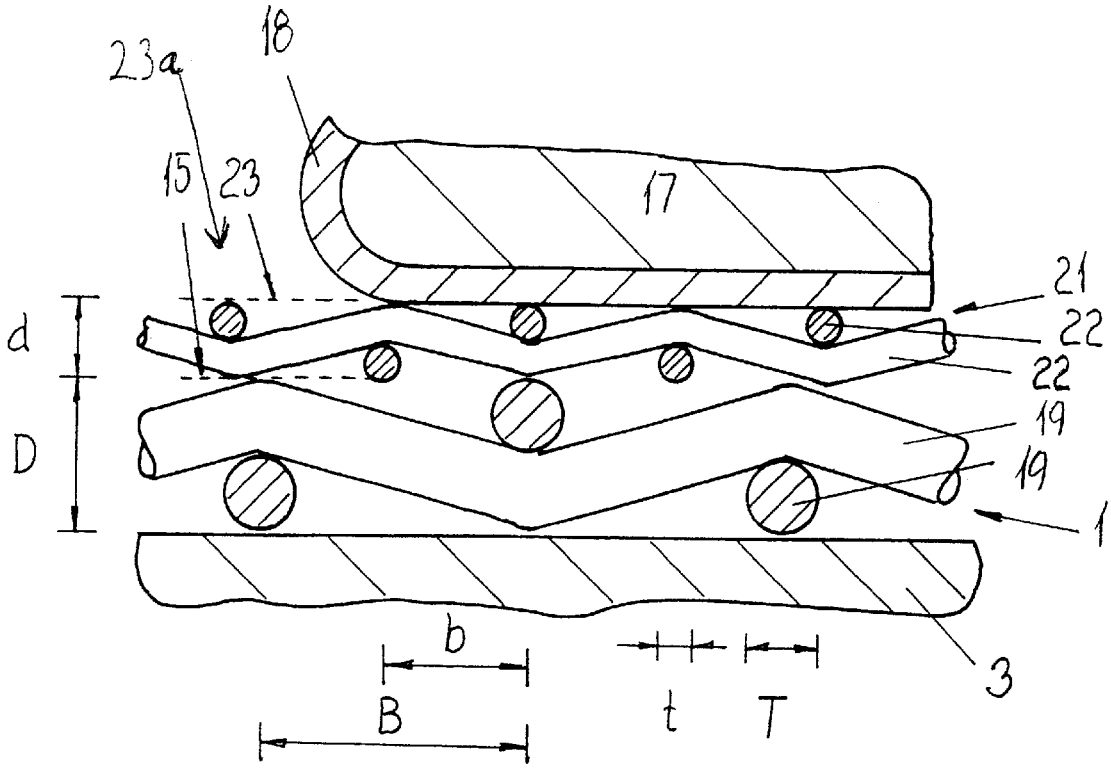
FIG. 6 is an enlarged sectional view of a part of the third embodiment of the sole when in use.

FIG. 6 shows a third embodiment where the sole comprises two nets 1,21 disposed in parallel. A coarse net 1 is woven of threads 19 with a thickness T and establishes a distance D between the top sheet 3 and the upper side 15 of the coarse net 1. Between the threads 19 there is a distance B defining the size of the meshes 20 between the threads 19. A fine net 21 is woven of threads 22 with a thickness t being less than the thickness T and establishes a distance d between the upper side 15 of the coarse net 1 and an upper side 23 of the fine net 21. Between the threads 22 is a distance b defining the size of the meshes 20 between the threads 22, and which distance b is less than the distance B. In this embodiment there is a free upper side 23*a* corresponding to the free upper side 15*a*.

The first coarsely woven net has relatively large meshes as the threads have a relatively large thickness T and a relatively large distance B between the threads. This implies that the coarse net is capable of accommodating relatively large amounts of air. However, since the threads are relatively thick with a thickness T and the distance B between the threads is relatively great, it will uncomfortable to tread on the coarse net as the pressure from the foot will be distributed on relatively few threads.

Therefore a second, more finely woven net is laid on top of the coarse net. In the fine net the diameter d of the threads is less and the distance b between the threads is less. This means that it is more comfortable to tread on this net as the pressure from the foot is distributed on more and thinner threads. However, the meshes between the fibres are smaller which means that the fine net is not capable of containing as much air as the coarse net. There is free access for air from the meshes in the fine net down to the meshes in the coarse net, so that the total amount of air that may be contained by the coarse and the fine net is determined by the meshes in the coarse net 1 and the fine net 21 together without any separation of the meshes. Furthermore, putting the two nets together will create a greater total distance, the sum of D and d, between the top sheet and the upper side 23 of the upper fine net 23.

Figure 7:
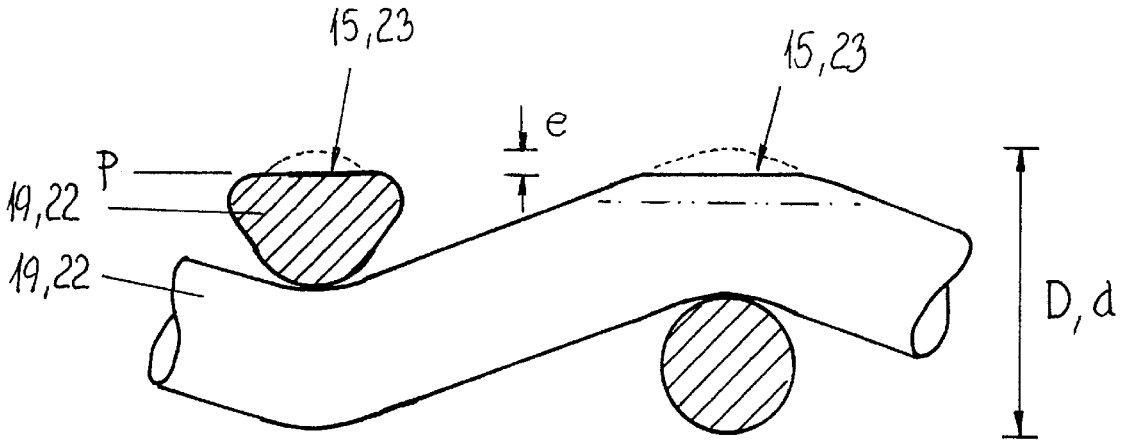
FIG. 7 is a sectional view of a possible weaving of the threads in the net of the sole.

FIG. 7 shows a possible alternative embodiment of the net. The upper side 15,23 of the net is deformed by the threads 19,22 being pressed the distance e downward compared with the distance D,d, and the threads are then deformed permanently. Thereby the upper side 15,23 of each thread 19,22 is flattened along a plane p, reducing the pressure from the threads against the foot (not shown). The reduced pressure against the foot reduces the friction and thereby heat generation when the foot is moved and thereby displaced slightly in relation to the net 1,21. This means that preparing the threads 19,22 as shown further reduces excretion of foot perspiration and thereby increases the efficiency of the net.

Figure 8:
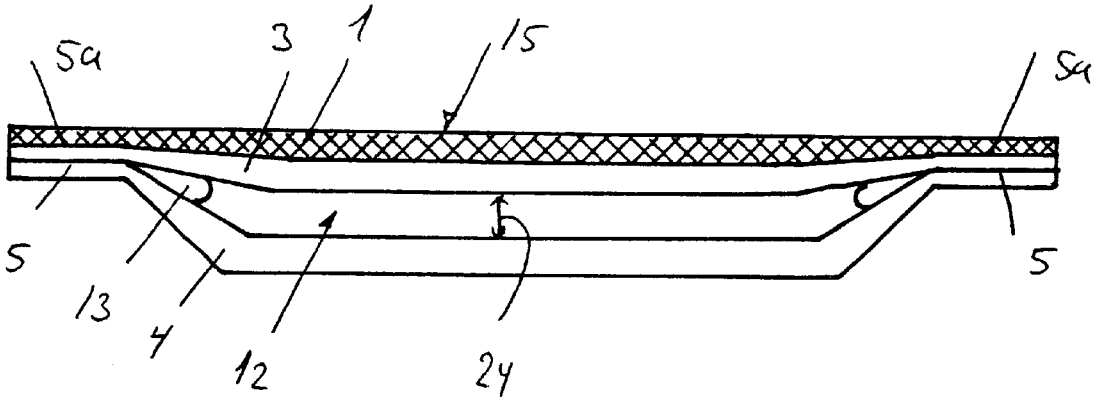
FIG. 8 is a transverse sectional view of an embodiment of the sole formed by a method according to the invention.

FIG. 8 shows a further embodiment of a sole. This insole is made by a method according to the invention as the joining takes place in two steps. Thus the top sheet 3 and the back sheet 4 are welded together at the edges 5 for establishing the chamber 12 containing the liquid. In the subsequent step, the net 1 is welded on at the edge area 5*a*. By this embodiment it becomes possible to achieve a plane upper side 15 of the net simultaneously with the height 24 in the chamber 12 being increased compared with the above illustrated embodiments. Hereby the relief and the liquid support of the foot may be considerably increased.

The invention is described above with reference to different embodiments of the insole according to the invention. It will be possible to make soles where liquid-filled part of the sole has another appearance as seen in parallel with the plane of the sole where more than a single chamber may be established between the top sheet and the back sheet and as seen perpendicularly to the plane of the sole where the top sheet and the back sheet may have other joints than the shown transverse line and the shown points. The net may be made of other materials than mentioned above, as well as it is possible to use more that one or two nets.

What is claimed is:

1. A liquid-filled insole for footwear which at least comprises a top sheet and a back sheet between which is formed a chamber containing liquid support for the foot in the footwear and in addition comprises a cover layer disposed on top of the support, the cover layer extending at least from an area at the heel of the foot to an area at the ball of the foot in the footwear, the cover layer spacing the support apart from the foot in the footwear, and where the cover layer is joined with the support, wherein the cover layer is a net and the outer edge of the net is joined with the top sheet and the back sheet, and wherein the net comprises a coarse net and a fine net, that the coarse net consists of threads with a given greater thickness T, that the fine net consists of threads with a given lesser thickness t less than the thickness T, and that the coarse net is disposed between the top sheet and the fine net, and that the fine net is disposed on top of the coarse net.

2. An insole according to claim 1, wherein the net at least also extends in the whole width (W) of the sole which is dimensioned so that a free upper side is created in the part of the net located outside the foot.

3. An insole according to claim 2, wherein the net extends over all the top sheet of the whole length of the sole (L) and of the whole width (W) of the sole, and that the net is joined with both the top sheet and the back sheet along the edges of the top sheet and the back sheet.

4. An insole according to claim 1, wherein the net consists of woven threads, that the threads are made of a plastic material selected among PVdC, PU, EVA and PVC, and that the net and the top sheet and the back sheet, respectively, are joined by high frequency welding.

5. An insole according to claim 1, wherein the net forms a distance (D,d) between the top sheet and the foot between 0.3 mm and 5.0 mm.

6. An insole according to claim 1, wherein the threads in the coarse net has a greater mutual distance B, and that the threads in the fine net has a mutual distance b lesser than the distance B.

7. An insole according to claim 1, wherein a moisture absorbing fabric coating is provided between the top sheet and the net.

8. An insole according to claim 1, wherein an upper side of the threads in the net has been deformed for establishing a plane upper side of the threads.

* * * * *